US010400530B2

(12) United States Patent
Hrametz et al.

(10) Patent No.: US 10,400,530 B2
(45) Date of Patent: Sep. 3, 2019

(54) FLUID FLOW DURING LANDING OF LOGGING TOOLS IN BOTTOM HOLE ASSEMBLY

(71) Applicant: Halliburton Energy Services, Inc., Houston, TX (US)

(72) Inventors: Andrew Albert Hrametz, Rosenberg, TX (US); Arabinda Misra, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 390 days.

(21) Appl. No.: 14/771,422

(22) PCT Filed: Apr. 19, 2013

(86) PCT No.: PCT/US2013/037413

§ 371 (c)(1),
(2) Date: Aug. 28, 2015

(87) PCT Pub. No.: WO2014/171952

PCT Pub. Date: Oct. 23, 2014

(65) Prior Publication Data

US 2016/0017678 A1 Jan. 21, 2016

(51) Int. Cl.
*E21B 17/04* (2006.01)
*E21B 23/01* (2006.01)
(Continued)

(52) U.S. Cl.
CPC ..... *E21B 23/01* (2013.01); *E21B 17/04* (2013.01); *E21B 23/08* (2013.01); *E21B 23/10* (2013.01); *E21B 49/00* (2013.01)

(58) Field of Classification Search
CPC ..... E21B 23/03; E21B 23/08; E21B 23/14; E21B 23/063; E21B 49/003; E21B 49/00; E21B 34/063; E21B 47/00
(Continued)

(56) References Cited

U.S. PATENT DOCUMENTS 3,378,069 A 4/1968 Fields
4,041,780 A 8/1977 Angehrn
(Continued)

FOREIGN PATENT DOCUMENTS

FR 2910048 A1 6/2008
FR 2910049 A1 6/2008
(Continued)

OTHER PUBLICATIONS

PCT International Preliminary Report on Patentability, PCT/US2013/037413, dated Oct. 29, 2015, 12 pages.
(Continued)

*Primary Examiner* — Giovanna C Wright
*Assistant Examiner* — Dany E Akakpo
(74) *Attorney, Agent, or Firm* — Alan Bryson; Parker Justiss, P.C.

(57) ABSTRACT

The present disclosure relates to systems, assemblies, and methods for facilitating fluid flow during/after landing of logging tools in a bottom hole assembly. In operation, a memory logging tool is lowered through a longitudinal bore of a drill pipe string and landed in a bottom hole assembly disposed at the end of the drill pipe string. Drilling fluid is pumped behind the logging tool to assist with downward movement of the tool. As the logging tools land, partial fluid flow path is blocked by the logging tools. The fluid pressure can rise in response to the narrowing of the fluid flow path. Facilitating fluid flow through and/or around the logging
(Continued)

tools can put the rising fluid pressure in a proper range for powering the logging tools to land and monitoring purposes.

11 Claims, 12 Drawing Sheets

(51) Int. Cl.
*E21B 23/08* (2006.01)
*E21B 49/00* (2006.01)
*E21B 23/10* (2006.01)

(58) Field of Classification Search
USPC ..... 166/381
See application file for complete search history.

(56) References Cited

U.S. PATENT DOCUMENTS

| | | | | |
|---|---|---|---|---|
| 4,349,072 | A | 9/1982 | Escaron et al. | |
| 4,485,870 | A | 12/1984 | Walulik | |
| 4,597,440 | A | 7/1986 | Pottier | |
| 4,664,189 | A | 5/1987 | Wittrisch | |
| 4,715,446 | A | 12/1987 | Wittrisch | |
| 4,729,429 | A | 3/1988 | Wittrisch | |
| 4,783,995 | A | 11/1988 | Michel et al. | |
| 4,790,380 | A | 12/1988 | Ireland et al. | |
| 4,807,717 | A | 2/1989 | Winters et al. | |
| 5,111,880 | A | 5/1992 | Wittrisch et al. | |
| 5,217,075 | A | 6/1993 | Wittrisch | |
| 5,566,757 | A | 10/1996 | Carpenter et al. | |
| 5,589,825 | A * | 12/1996 | Pomerleau | E21B 47/01 175/40 |
| 6,119,777 | A | 9/2000 | Runia | |
| 6,419,013 | B1 | 7/2002 | Milne et al. | |
| 6,488,085 | B1 | 12/2002 | Milne et al. | |
| 6,578,631 | B2 | 6/2003 | Milne et al. | |
| 6,755,257 | B2 | 6/2004 | Spencer et al. | |
| 6,843,317 | B2 | 1/2005 | Mackenzie | |
| 7,188,672 | B2 | 3/2007 | Berkheimer et al. | |
| 7,201,231 | B2 | 4/2007 | Chaplin et al. | |
| 7,363,967 | B2 | 4/2008 | Burris, II et al. | |
| 7,537,061 | B2 | 5/2009 | Hall et al. | |
| 7,661,475 | B2 | 2/2010 | Sheiretov et al. | |
| 7,905,282 | B2 | 3/2011 | Bissonnette et al. | |
| 8,022,838 | B2 | 9/2011 | Murphy | |
| 8,561,697 | B2 | 10/2013 | Strickland | |
| 8,689,867 | B2 | 4/2014 | MacDougall et al. | |
| 2002/0057210 | A1 | 5/2002 | Frey et al. | |
| 2002/0117300 | A1 | 8/2002 | Spencer et al. | |
| 2003/0056984 | A1 | 3/2003 | Smith et al. | |
| 2003/0058125 | A1 | 3/2003 | Ciglenec et al. | |
| 2004/0069488 | A1 | 4/2004 | Chaplin et al. | |
| 2004/0245020 | A1 | 12/2004 | Giroux et al. | |
| 2005/0167098 | A1 | 8/2005 | Lovell et al. | |
| 2006/0054354 | A1 | 3/2006 | Orban | |
| 2006/0118298 | A1 | 6/2006 | Millar et al. | |
| 2006/0220651 | A1 | 10/2006 | Clark | |
| 2007/0119626 | A9 | 5/2007 | Giroux et al. | |
| 2007/0284116 | A1* | 12/2007 | Hall | E21B 23/14 166/385 |
| 2008/0093124 | A1 | 4/2008 | Giroux et al. | |
| 2008/0110673 | A1 | 5/2008 | Giroux et al. | |
| 2008/0202767 | A1 | 8/2008 | Sheiretov et al. | |
| 2008/0236841 | A1 | 10/2008 | Howlett et al. | |
| 2009/0014175 | A1 | 1/2009 | Peter | |
| 2009/0045975 | A1 | 2/2009 | Evans et al. | |
| 2009/0194271 | A1 | 8/2009 | Bissonnette et al. | |
| 2009/0299654 | A1 | 12/2009 | Garvey et al. | |
| 2010/0089567 | A1 | 4/2010 | Constantinou et al. | |
| 2010/0132955 | A1 | 6/2010 | Storm, Jr. et al. | |
| 2011/0083845 | A1 | 4/2011 | McLaughlin | |
| 2011/0308797 | A1 | 12/2011 | Umphries et al. | |
| 2015/0337643 | A1* | 11/2015 | Leach | E21B 41/0007 166/250.01 |

FOREIGN PATENT DOCUMENTS

| | | | |
|---|---|---|---|
| GB | 2344123 | A | 5/2000 |
| WO | WO 96/001359 | | 1/1996 |
| WO | WO 00/17488 | | 3/2000 |
| WO | WO 00/060212 | | 10/2000 |
| WO | WO 02/073003 | A1 | 9/2002 |
| WO | WO 10/089525 | | 8/2010 |
| WO | WO 2013/133860 | | 9/2013 |
| WO | WO 2013/133861 | | 9/2013 |
| WO | WO 2013/133890 | | 9/2013 |

OTHER PUBLICATIONS

Australian Pre-Examination Processing Notice, Australian Application No. 2013386825, dated Feb. 19, 2016, 2 pages.

Authorized Officer Lee, Jong Kyung, International Search Report and Written Opinion in International Application No. PCT/US2013/037413, Issued by European Patent Office, dated Jan. 20, 2014, 16 pages.

Runia et al., "Through Bit Logging: A New Method to Acquire Log Data, and a First Step on the Road to Through Bore Drilling" SPWLA 45th Annual Logging Symposium, Jun. 6-9, 2004, 8 pages.

Runia et al., "Through Bit Logging: Applications in Difficult Wells, Offshore North Sea" SPE/IADC 92256, Feb. 23-25, 2005, 8 pages.

* cited by examiner

B

243

251

FLUID FLOW DURING LANDING OF LOGGING TOOLS IN BOTTOM HOLE ASSEMBLY

This disclosure relates to a method and assembly for conveying logging tools in a wellbore and more particularly fluid flow associated with landing of logging tools in a bottom hole assembly.

BACKGROUND

In oil and gas exploration it is important to obtain diagnostic evaluation logs of geological formations penetrated by a wellbore drilled for the purpose of extracting oil and gas products from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art, such as Neutron logs, Gamma Ray logs, Resistivity logs and Acoustic logs. Logging tools are frequently used for data logging/acquisition in a wellbore by logging in an upward (up hole) direction, from a bottom portion of the wellbore to an upper portion of the wellbore. The logging tools, therefore, need first be conveyed, usually inside a drill pipe string, to the bottom portion of the wellbore (e.g., a bottom hole assembly at the lower end of the drill pipe string). In many instances, the logging tools are powered by pressurized fluid (e.g., mud pumped and circulated in the wellbore) to travel in a highly deviated wellbore that includes a substantially horizontal section to land at a specific depth

DETAILED DESCRIPTION

The present disclosure relates to systems, assemblies, and methods for facilitating fluid flow during/after landing of logging tools in a bottom hole assembly. In many instances, logging tools carried in a logging tool string are conveyed in a drill pipe string, and landed in a bottom hole assembly at the end of the drill pipe string, in a long deviated well that requires significant pumping pressure for powering the logging tools downwards. The pressure can also be used to monitor the condition, position, and status of the logging tools. The disclosed fluid flow systems, assemblies, and methods can facilitate a continuous measurable pressure for powering and monitoring the logging tools during landing.

For example, as the logging tools land, partial fluid flow path is blocked by the logging tools. The fluid pressure can rise in response to the narrowing of the fluid flow path. Facilitating fluid flow through and/or around the logging tools can put the rising fluid pressure in a proper range for powering the logging tools to land and monitoring purposes. Additionally, fluid flow down through the logging tool string and out the end of the bottom hole assembly prevents the bottom hole assembly and the logging tool string from becoming stuck in the wellbore.

In a general implementation, fluid is pumped into the upper proximal end of a drill pipe string bore above a logging tool string to assist movement of the logging tool string downwards by applying fluid pressure on the logging tool string. The fluid flows down the drill pipe string and around the logging tool string, then out the end of the bottom hole assembly that is at the end of the drill pipe string. The landing assembly of the logging tool string is landed in the landing sub of the drill pipe. At least a portion of the logging tool string is disposed below the distal end of the bottom hole assembly. The fluid from the longitudinal bore of the drill pipe string is diverted through at least one upper bypass port in the landing assembly into at least one internal flow passage in the landing assembly. The fluid flows through the internal passage way of the landing assembly and out at least one lower bypass port in the landing assembly. The fluid then flows through an annular space around the logging tool string and out of a lower end of the bottom hole assembly. Detailed examples are discussed below.

Figure 1A:
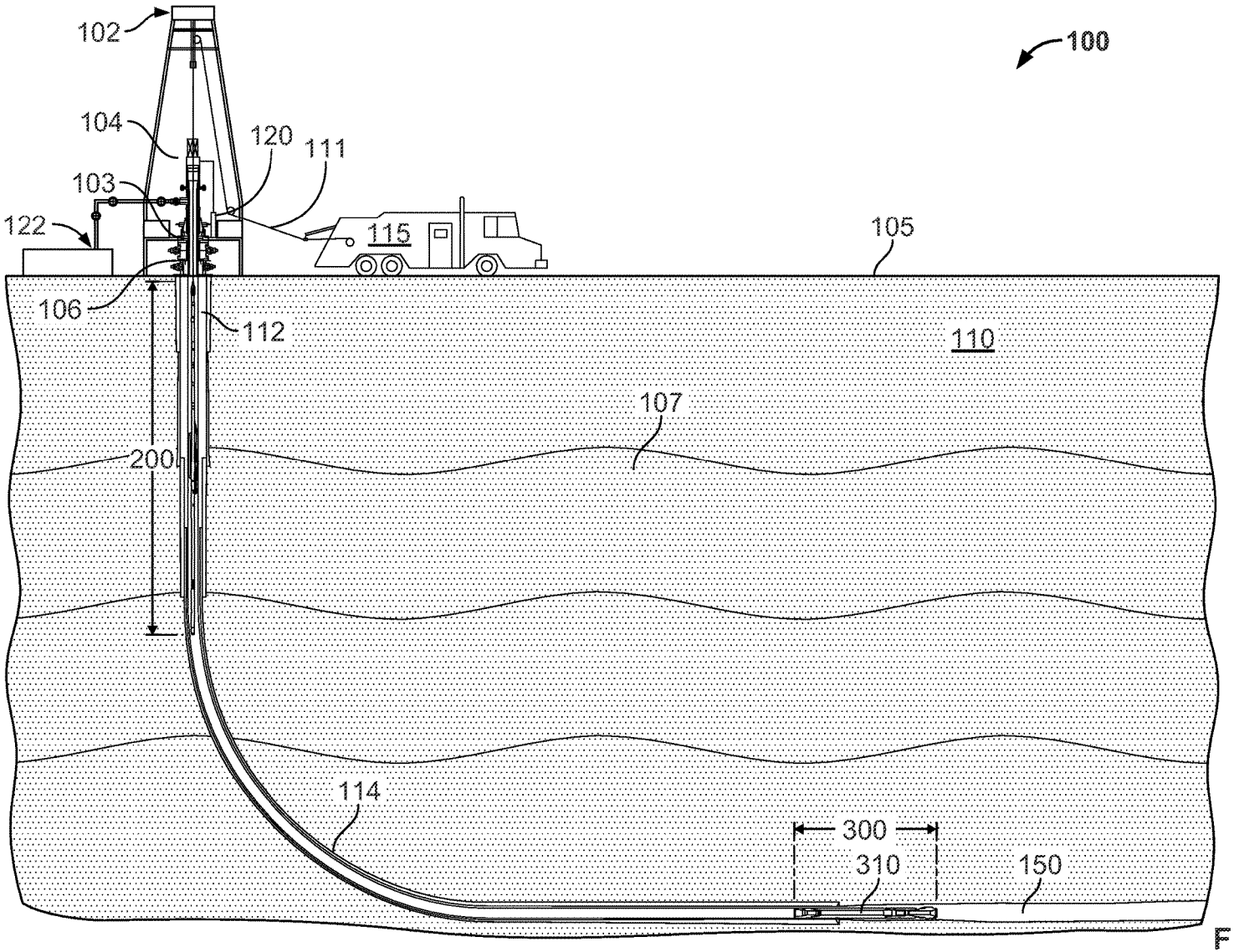
FIGS. 1A to 1E illustrate operations of a logging tool conveying system.

FIGS. 1A to 1E illustrate operations of a logging tool conveying system 100. The logging tool conveying system 100 includes surface equipment above the ground surface 105 and a well and its related equipment and instruments below the ground surface 105. In general, surface equipment provides power, material, and structural support for the operation of the logging tool conveying system 100. In the embodiment illustrated in FIG. 1A, the surface equipment includes a drilling rig 102 and associated equipment, and a data logging and control truck 115. The rig 102 may include equipment such as a rig pump 122 disposed proximal to the rig 102. The rig 102 can include equipment used when a well is being logged such as a logging tool lubrication assembly 104 and a pack off pump 120. In some implementations, a blowout preventer 103 will be attached to a casing head 106 that is attached to an upper end of a well casing 112. The rig pump 122 provides pressurized drilling fluid to the rig and some of its associated equipment. The data logging and control truck 115 monitors the data logging operation and receives and stores logging data from the logging tools. Below the rig 102 is a wellbore 150 extending from the surface 105 into the earth 110 and passing through a plurality of subterranean geologic formations 107. The wellbore 150 penetrates through the formations 107 and in some implementations forms a deviated path, which may include a substantially horizontal section as illustrated in FIG. 1A. Near the surface 105, part of the wellbore 150 may be reinforced with the casing 112. A drill pipe string 114 can be lowered into the wellbore 150 by progressively adding lengths of drill pipe connected together with tool joints and extending from the rig 102 to a predetermined position in the wellbore 150. A bottom hole assembly 300 may be attached to the lower end of the drill pipe string before lowering the drill pipe string 114 into the wellbore. The drill pipe string 114 can receive a logging tool string 200 that can land onto the bottom hole assembly 300. After landing, the logging tool string 200 can be pulled up and start data logging as it travels upwards.

Figure 3A:
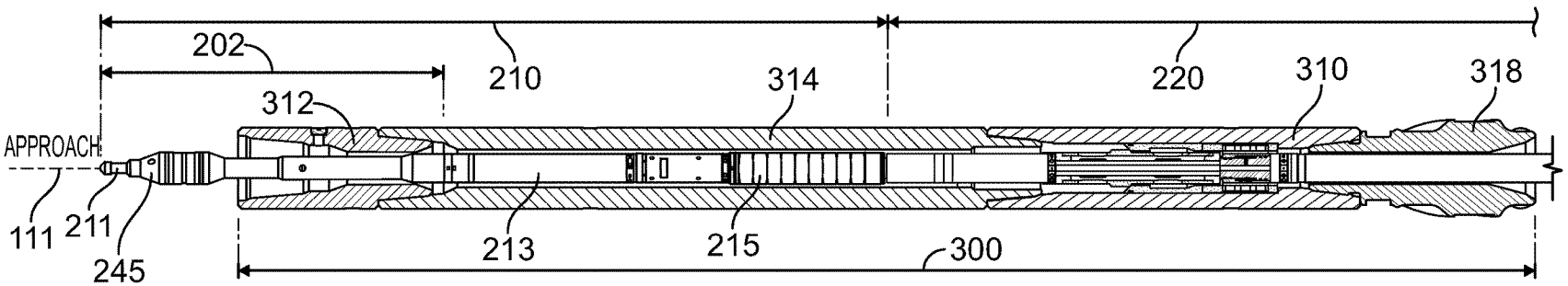
FIGS. 3A to 3C are cross-sectional side views of the logging tool string inside a bottom hole assembly during different operational phases.

In a general aspect, referring to FIGS. 3A, 3B, 3C, and 4, the bottom hole assembly 300 includes four major sections: the nozzle sub 312, the spacer sub 314, the landing sub 310, and the deployment sub 318. The nozzle sub 312 can function as a connector for attachment to the distal end of the drill pipe string 114, and may be configured such that the logging tool string 200 can be received at and guided through the nozzle sub 312 when the logging tool string 200 enters the bottom hole assembly 300 (FIG. 3A). The spacer sub 314 can define/determine the distance between the nozzle sub 312 and the landing sub 310. The landing sub 310 can include a bore there through and a landing sleeve 340 that receives the logging tool string 200 during landing. For example, the landing sub 310 can include a landing shoulder, a fluid by-pass tool, and a number of control coupling magnets for the landing operation. The deployment sub 318 can be the lowermost distal piece of the bottom hole assembly 300 constraining the logging assembly 220, which extends beyond the deployment sub 318 with data logging instruments. In some implementations the deployment sub 318 may be replaced with a modified reamer or hole opener for reaming through a tight spot in the previously drilled wellbore, each of which may be configured to have a longitudinal passage adapted to allow the passage of the logging assembly there through. In other implementations, the deployment sub may not be present and the landing sub may include a lower cutter or reamer that would provide the ability to ream through a tight spot in the preexisting wellbore.

A landing sleeve 340 is centrally placed in the landing sub 310. The landing sleeve 340 includes a landing shoulder 344. A landing bumper 244 of the tool body 202 is configured to engage the landing shoulder 344 to retain the tool sting 200 and prevent the string from being pumped completely out of the end of the bottom hole assembly 300. When the landing bumper 244 of tool body 201 contacts the landing shoulder 344 of the landing sub 310, the movement of the logging tool string 200 is stopped but fluid should be allowed to flow through or around the logging tool string in order to allow fluid flow at or near the end of the bottom hole assembly 300. Fluid flow out the end or proximal to the end of the bottom hole assembly and up the annulus between the bottom hole assembly and the well bore wall assists in prevention of sticking the bottom hole assembly in the wellbore. The fluid (F) may be ultimately received at the surface and recirculated down the well bore. Briefly turning to FIG. 4, a configuration at landing is shown. One or more bypass ports 242 in the sidewall of the tool body are located above the landing shoulder 344 of the landing sleeve 340. Fluid (F) flows into the tool body 202 through ports 242 above the landing shoulder 344 and downward through the logging tool string 200. The fluid (F) exits through ports 246 in the sidewall of the tool body 202 below the landing shoulder 344. The fluid (F) then flows along the annular space between the logging tool string 200 and the slim bottom hole assembly 300. The fluid (F) then flows out the terminal end or proximal to the terminal end of the bottom hole assembly 300. As noted above, fluid flow out the end or proximal to the end of the bottom hole assembly and up the annulus between the bottom hole assembly and the well bore wall assists in prevention of sticking the bottom hole assembly in the wellbore. The fluid (F) may be ultimately received at the surface and recirculated down the well bore.

Figure 4:
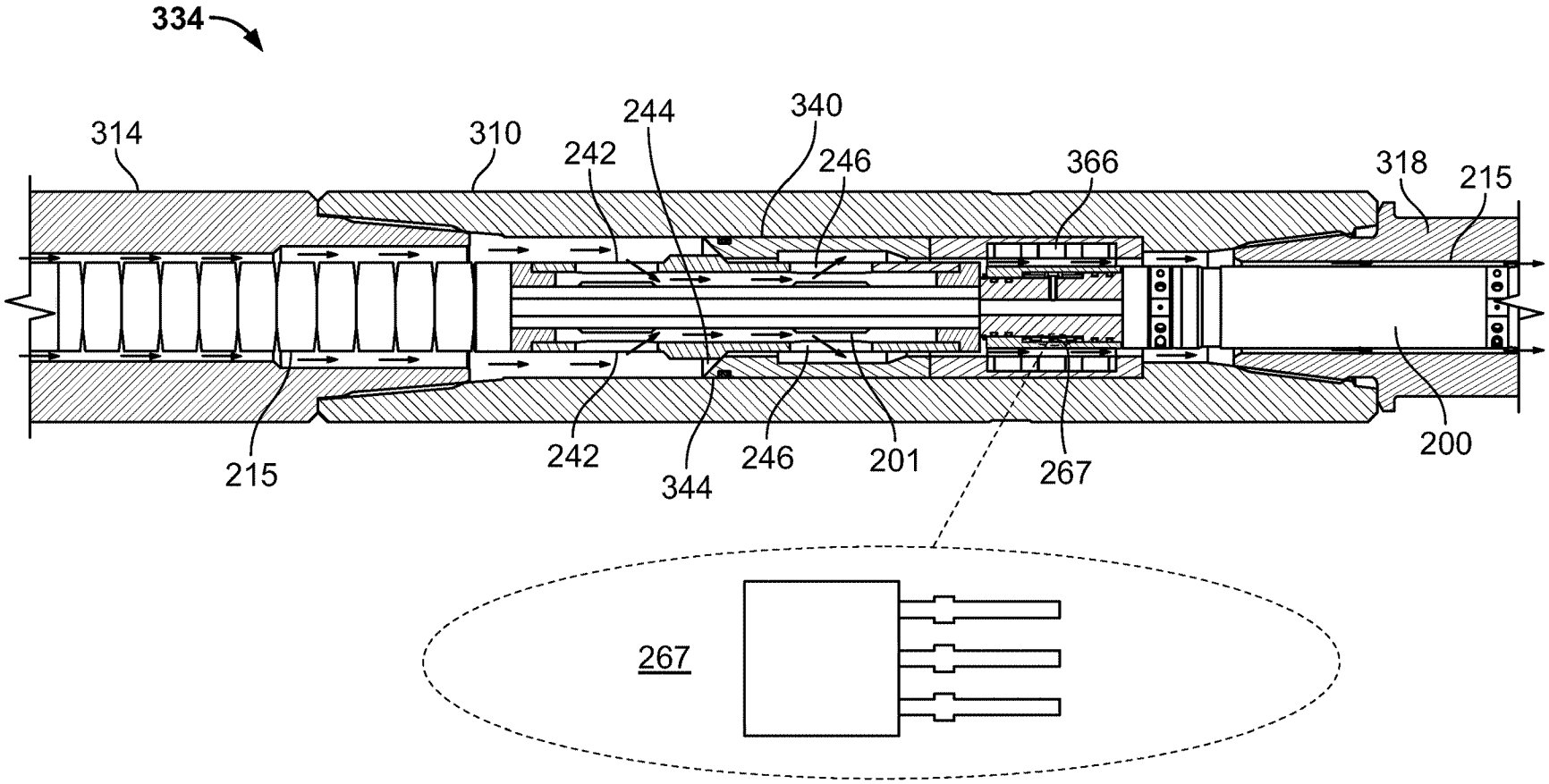
FIG. 4 is a detail partial half cross-sectional view of a portion of the logging tool string and the bottom hole assembly illustrating fluid flow ports and flow of fluid during landing of a logging tool string in a bottom hole assembly.

Various mechanisms can be used to monitor and/or signal the landing, after which a logging sequence can be activated. In some implementations the landing sleeve 340 houses a number of magnets 366 that can be used to activate switches in the logging tool string 200. In the implementation of FIG. 4, a Hall Effect sensor 267 is used as a switch. The Hall Effect sensor 267 is an analog transducer that varies its output voltage in response to a magnetic field. The sensor 267 can be combined with electronic circuitry that allows the device to act in a digital (on/off) mode, i.e., a switch. In this implementation, rare earth magnets located in the landing sub can trigger the sensor 267. In other implementations, reed switches may be actuated by the magnets when the logging tool string 200 is landed. For example, reeds can be deflected to contact each other when the reed switch becomes near the magnets. The magnets can be permanent magnets or electromagnets. Once the Hall Effect sensor 267 or reed switch is activated by being positioned proximal to the magnets in the landing sub 310, an automated self-diagnosis can be initiated in the logging tool string 200 by the diagnostic module to determine when the running tool 202 can be released.

Other implementations of switches (not illustrated) may be used instead of the Hall Effect sensor 267 or reed switch. For example, another implementation uses a mechanical switch. The mechanical switch accomplishes the same function as all the other embodiments of sensing when the tool has landed in the landing sub and sends an on/off command to the logging tool string. The mechanical switch is triggered when a spring loaded plunger is depressed as the shock sub engages the landing sub. In another implementation, a "Giant Magneto Restrictive" (GMR) is used as a switch. In some implementations a GMR is formed of thin stacked layers of ferromagnetic and non-magnetic materials which when exposed to a magnetic field produces a large change in the devices electrical resistance. The magnetic flux concentrators on the sensor die gather the magnetic flux along a reference axis and focus it at the GMR bridge resistors in the center of the die. The sensor will have the largest output signal when the magnetic field of interest is parallel to the flux concentrator axis and can be combined with electronic circuitry that allows the device to act in a digital (on/off) mode, i.e., switch. The trigger for this embodiment would be rare earth magnets located in the landing sub.

In another implementation, a proximity sensor (not illustrated) can be used as a switch. The proximity sensor is able to detect the presence of metallic objects without any physical contact. In some implementations, a proximity detector uses a coil to emit a high frequency electromagnetic field and looks for changes in the field or return signal in the presence or absence of metal. This change is detected by a threshold circuit which acts in a digital (on/off) mode, i.e., switch. The trigger for this embodiment would be a nonferrous sleeve located in the landing bypass sub. In an alternative implementation, the Proximity Detector/Mutual Inductance Sensor could also be relocated in the logging tool string so that when the tool lands in the landing sub the sensor would be positioned just past the deployment sub and out into the open borehole a short distance past any ferrous metals. The sensor would interpret this as being in the presence of metal and the absence of metal acting as an on/off switch.

Returning now to FIGS. 1A to 1E, wherein operations of a logging tool conveying system 100 are illustrated. At a starting position as shown in FIG. 1A, the logging tool string 200 is inserted inside the drill pipe string 114 near the upper end of the longitudinal bore of the drill pipe string 114 near the surface 105. The logging tool string 200 may be attached with a cable 111 via a crossover tool 211. As noted above, the bottom hole assembly 300 is disposed at the lower end of the drill pipe string 114 that has been previously lowered into the wellbore 150. The bottom hole assembly 300 may include a landing sub 310 that can engage with the logging tool string 200 once the logging tool string 200 is conveyed to the bottom hole assembly 300. The conveying process is conducted by pumping a fluid from the rig pump 122 into the upper proximal end of the drill pipe string 114 bore above the logging tool string 200 to assist, via fluid pressure on the logging tool string 200, movement of the logging tool string 200 down the bore of the drill pipe string 114.

A landing bumper 244 of the tool body 201 can be profiled to engage the landing shoulder 344 to retain the tool sting 200 and prevent the string from being pumped completely out of the end of the bottom hole assembly 300. When the landing bumper 244 contacts the landing shoulder 344 of the landing sub 310, the movement of the logging tool string 200 is stopped, but fluid is allowed to flow through or around the logging tool string in order to allow fluid flow at or near the end of the bottom hole assembly 310. The fluid pressure above the logging tool string 200 is monitored constantly, for example, by the data logging control truck, because the fluid pressure can change during the conveying process and exhibit patterns indicating events such as landing the logging tool string 200 at the bottom hole assembly 300. As the logging tool string 200 is pumped (propelled) downwards by the fluid pressure that is pushing behind the logging tool string 200 down the longitudinal bore of the drill pipe string 114, the cable 111 is spooled out at the surface.

Figure 1B:
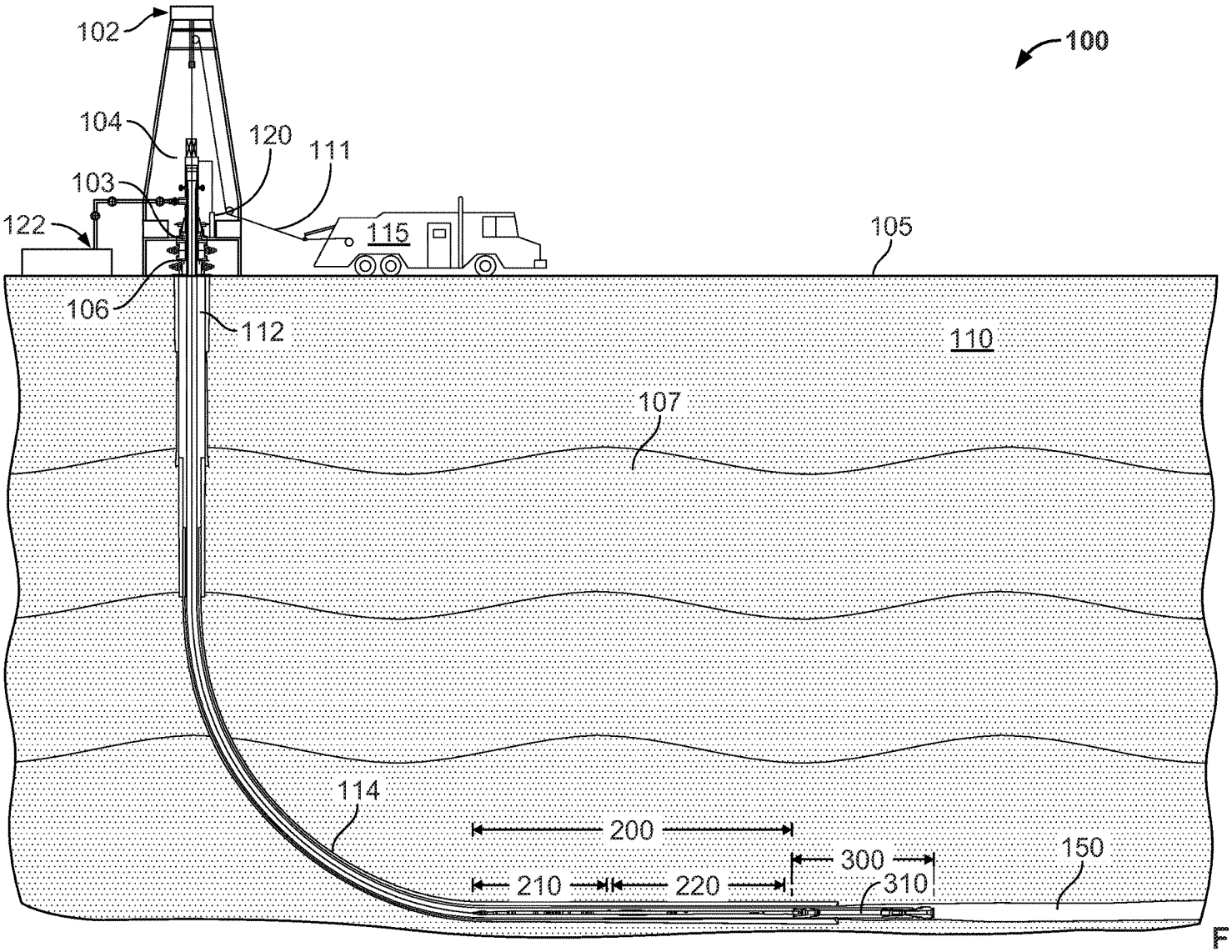

In FIG. 1B, the logging tool string 200 is approaching the bottom hole assembly 300. The logging tool string 200 is to be landed in the landing sub 310 disposed in the bottom hole assembly 300 which is connected to the distal lower portion of the drill pipe 114. At least a portion of the logging tool string 200 has logging tools that, when the logging tool string is landed in the bottom hole assembly 300, will be disposed below the distal end of the bottom hole assembly of the drill pipe string 114. In some implementations, the logging tool string 200 includes two portions: a landing assembly 210 and a logging assembly 220. As illustrated in FIG. 1B, the landing assembly 210 is to be engaged with the bottom hole assembly 300 and the logging assembly 220 is to be passed through the bottom hole assembly 300 and disposed below the bottom hole assembly. This enables the logging tools to have direct access to the geologic formations from which log data is to be gathered. Details about the landing assembly 210 and the logging assembly 220 are described in FIGS. 2A to 2E. As the logging tool string 200 approaches the bottom hole assembly 300, the rig pump 122 fluid pressure is observed at the surface 105, for example, at the data logging control truck 115.

Figure 5:
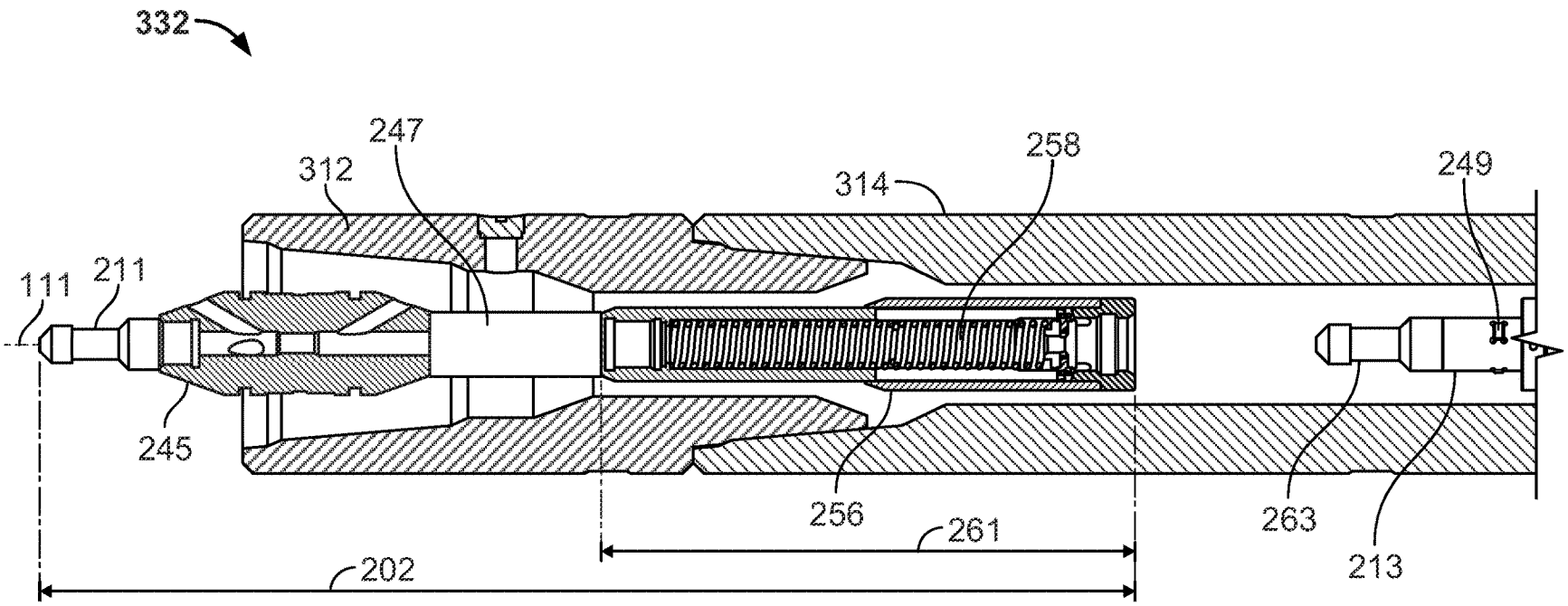
FIG. 5 is a detail half cross-section view of a portion of the logging tool string with the running tool released from the logging tool string landed in the bottom hole assembly.

A sudden increase of the fluid pressure can indicate that the logging tool string 200 has landed in the landing sub 310 of the bottom hole assembly 300. For example, in FIG. 1C, the logging tool string 200 has landed and engaged with landing sub 310 of the bottom hole assembly 300. The fluid pressure increases because the fluid is not able to circulate past the outside of the upper nozzle 245 when it is seated in the nozzle sub 312. A self-activating diagnostic sequence can be automatically initiated by a diagnostic module located in the logging assembly 220 to determine if the logging assembly 220 is properly functioning. Referring to FIG. 1D, when the proper functioning of the logging tool 220 is confirmed by the downhole diagnostics module, instructions are sent from the downhole diagnostics module to the downhole motor release assembly 213 to release the running tool 202 from the logging tool string 200 and displace the running tool 202 away from the upper end of the logging tool string 200. The running tool 202 includes a crossover tool 211 that connects the cable 111 to the upper nozzle 245 and the spring release assembly 261. A decrease in the pump pressure can then be observed as indicative of release and displacement of the running tool 202 from the logging tool string 200 which again allows fluid to freely circulate past upper nozzle 245. Once the pressure decrease has been observed at the surface, the cable 111 is spooled in by the logging truck 115. A release operation detail view 332 of the release of part of the running tool 202 is shown in FIG. 5. The release operation detail view 332 shows detachment of the spring release assembly 261 from the fishing neck 263. The motor release assembly 213 can include a motorized engagement mechanism that activates the spring release dogs 249 that are securing the running tool 202 to the fishing neck 263. The spring release assembly 261 can include a preloaded spring 258 which forcibly displaces the running tool 202 from the landing nozzle 312.

Figure 1C:
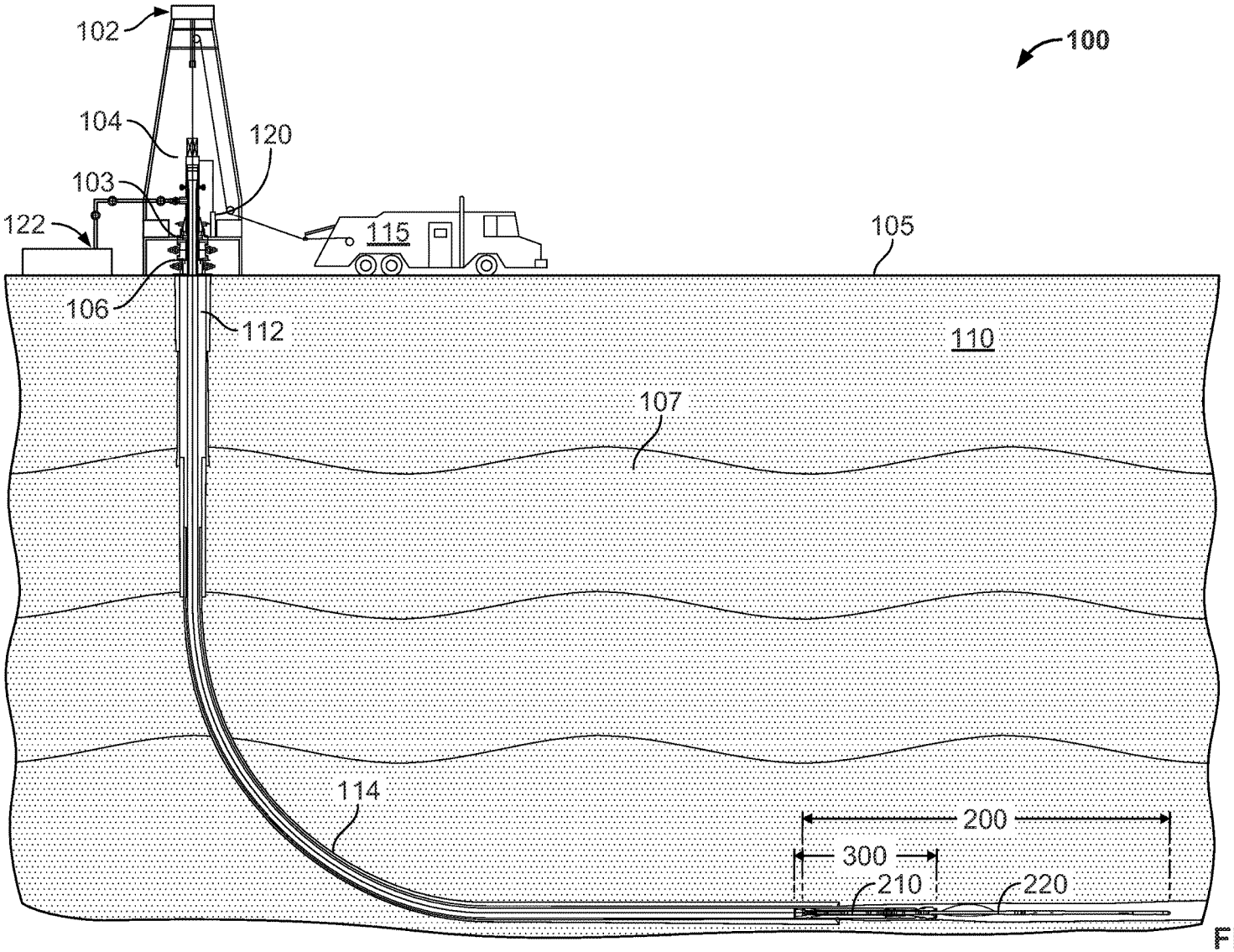
Figure 1D:
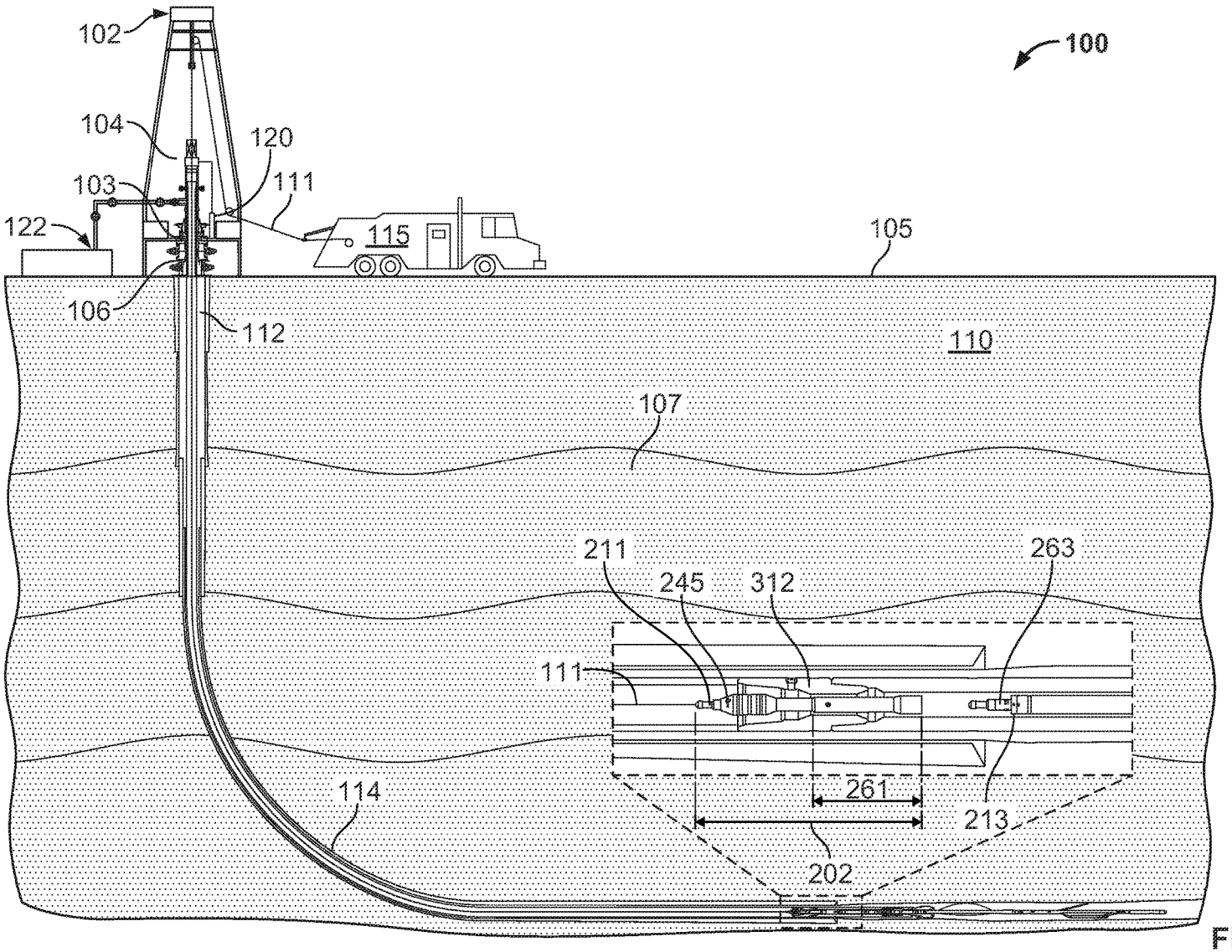
Figure 1E:
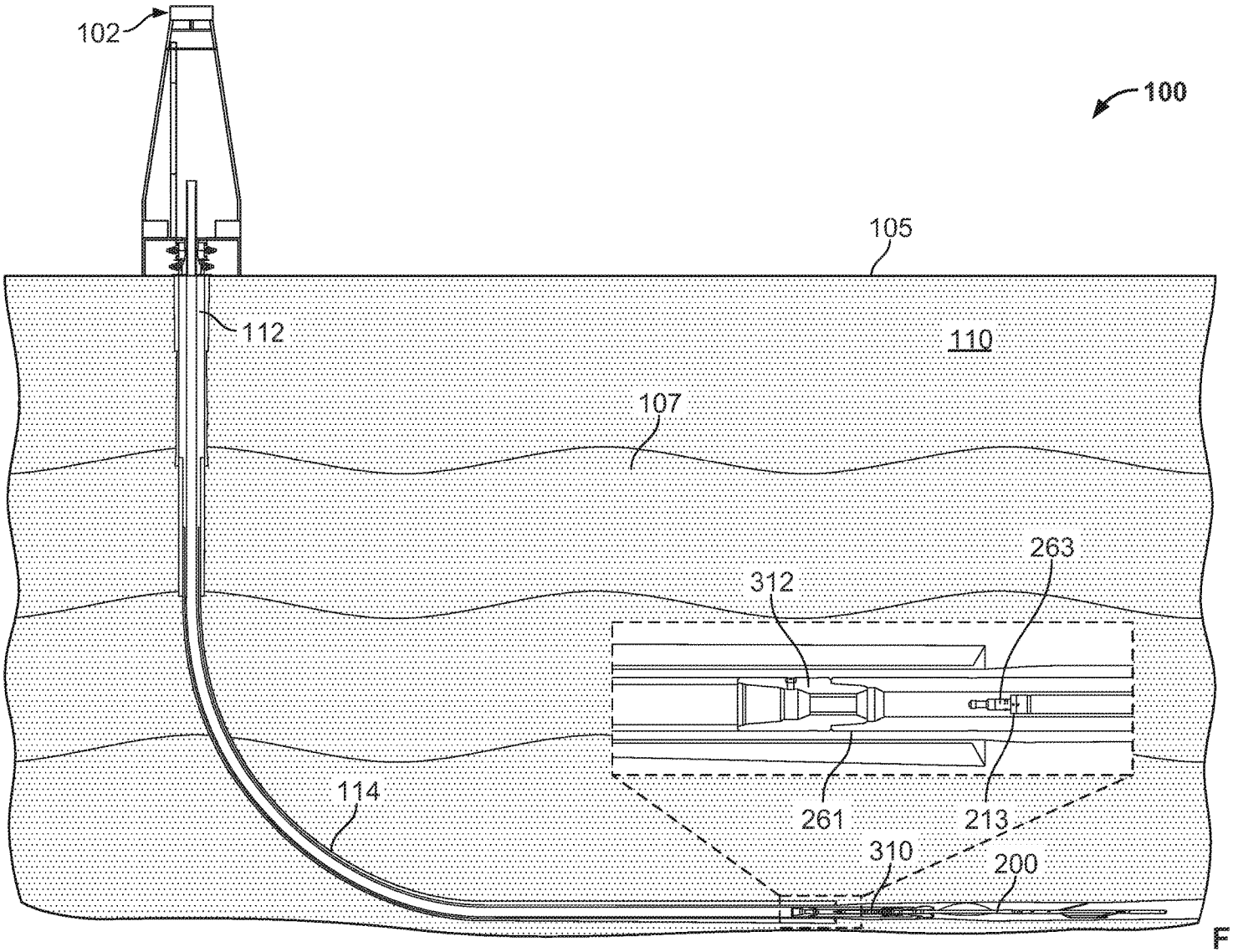

In FIG. 1E, the cable 111 and the running tool 202 have been completely retrieved and removed from drill pipe string 114. The system 100 is ready for data logging. As discussed above, the logging assembly 220 is disposed below the lower end of the bottom hole assembly 300 and can obtain data from the geologic formations as the logging assembly 220 moves past the formations. The drill pipe string 114 is pulled upward in the wellbore 150 and as the logging tool assembly 220 moves past the geologic formations, data is recorded in a memory logging device that is part of the logging assembly 220 (shown in FIGS. 2A to 2E). The drill pipe string is pulled upward by the rig equipment at rates conducive to the collection of quality log data. This pulling of the drill pipe string from the well continues until the data is gathered for each successive geologic formation of interest. After data has been gathered from the uppermost geologic formations of interest, the data gathering process is completed. The remaining drill pipe and bottom hole assembly containing the logging tool string 200 is pulled from the well to the surface 105. In some implementations, the logging tool string 200 can be removed from the well to the surface 105 by lowering on a cable 111 a fishing tool adapted to grasp the fishing neck 263 while the logging tool string and drill pipe are still in the wellbore. The tool grasps the fishing neck and then the cable is spooled in and the tool and the logging tool string are retrieved. The data contained in the memory module of the logging assembly 220 is downloaded and processed in a computer system at the surface 105. In some implementations, the computer system can be part of the data logging control truck 115. In some implementations, the computer system can be off-site and the data can be transmitted remotely to the off-site computer system for processing. Different implementations are possible. Details of the logging tool string 200 and the bottom hole assembly 300 are described below.

Figures 2A, 2B, 2C, 2D:
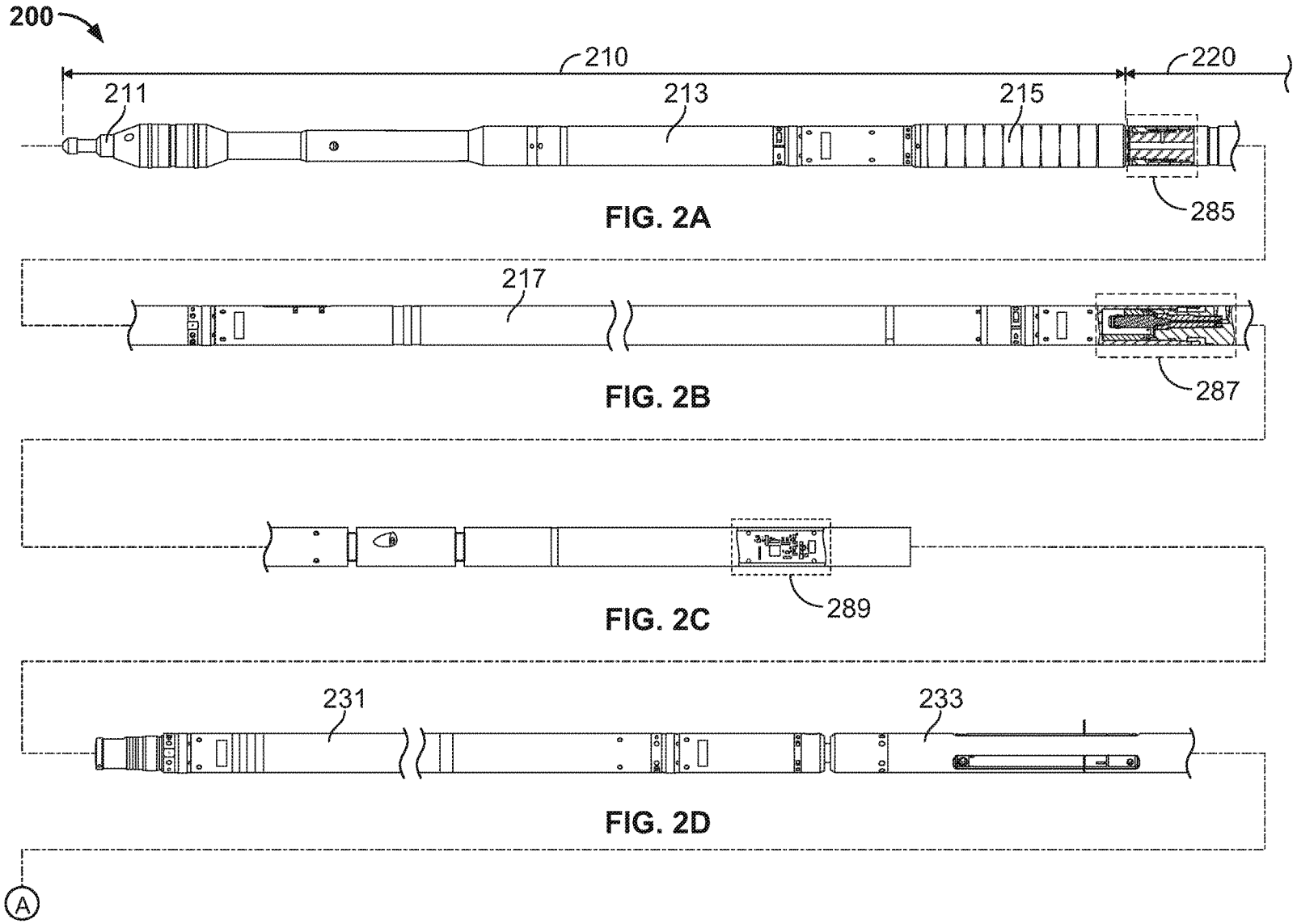
FIGS. 2A to 2K are side views of a logging tool string applicable to the operations illustrated in FIGS. 1A to 1E.

FIGS. 2A to 2K are side views of the logging tool string 200 applicable to the operations illustrated in FIGS. 1A to 1E. The logging tool string 200 includes two major sections: the landing assembly 210, and the logging assembly 220 that can be separated at a shock sub 215. Referring to FIGS. 2A and 2B, the complete section of the landing assembly 210 and a portion of the logging assembly 220 are shown. The landing assembly 210 can include the crossover tool 211, a nozzle 245, a spring release assembly 261, a motorized tool assembly 213, and the shock sub 215. The landing assembly 210 allows the logging tool string 200 to engage with the bottom hole assembly 300 without damage to onboard instruments. A running tool 202 comprises a subset of the landing assembly 210. The running tool 202 includes the crossover tool 211 and the spring release assembly 261.

Retrieval of the running tool 202 will be described later herein. The logging assembly 220 includes various data logging instruments used for data acquisition, for example, a battery sub section 217, a sensor and inverter section 221, a telemetry gamma ray tool 231, a density neutron logging tool 241, a borehole sonic array logging tool 243, a compensated true resistivity tool array 251, among others. An accelerometer 222 is located in invertor section 221. In some embodiments, the accelerometer 222 is a MEMS Technology, micro-electro-mechanical-system. This electro-mechanical device is located onto a silicon chip and is part of the sensor printed circuit board located in the inverter section 221. This sensor measures movement or acceleration in the Z axis. The Z axis is in line with the up and down motion of the logging tool string, e.g., running in and out of the well.

Referring to the landing assembly 210, the running tool 202 is securely connected with the cable 111 by crossover tool 211. As the logging tool string 200 is propelled down the bore of the drill pipe string by the fluid pressure, the rate at which the cable 111 is spooled out maintains movement control of the logging tool string 200 at a desired speed. After landing of the logging tool string 200, the running tool can be released by the motorized tool assembly 213. The motorized tool releasable subsection 213 includes an electric motor and a release mechanism including dogs 249 for releasing the running tool section 202 from the fishing neck disposed on the upper portion of the logging assembly 220. The electric motor can be activated by a signal from the diagnostic module in the logging assembly after the diagnostic module has confirmed that the logging assembly is operating properly. The electric motor can actuate the dogs 249 to separate the running tool 202 from the rest of the landing assembly 210.

Referring to the logging assembly 220 in FIG. 2A. The logging assembly 220 and the landing assembly 210 are separated at the shock sub 215. One major functional section behind the shock sub 215 is the battery sub section 217. The battery sub section 217 can include high capacity batteries for logging assembly 220's extended use. For example, in some implementations, the battery sub section 217 can include an array of batteries such as Lithium ion, lead acid batteries, nickel-cadmium batteries, zinc-carbon batteries, zinc chloride batteries, NiMH batteries, or other suitable batteries. In FIG. 2C, the sensor and invertor section 221 is included in the logging assembly 220. The sensor and invertor section 221 can include sensors for detecting variables used for control and monitoring purposes (e.g., accelerometers, thermal sensor, pressure transducer, proximity sensor), and an inverter for transforming power from the battery sub section 217 into proper voltage and current for data logging instruments.

Figures 2E, 2F, 2G:
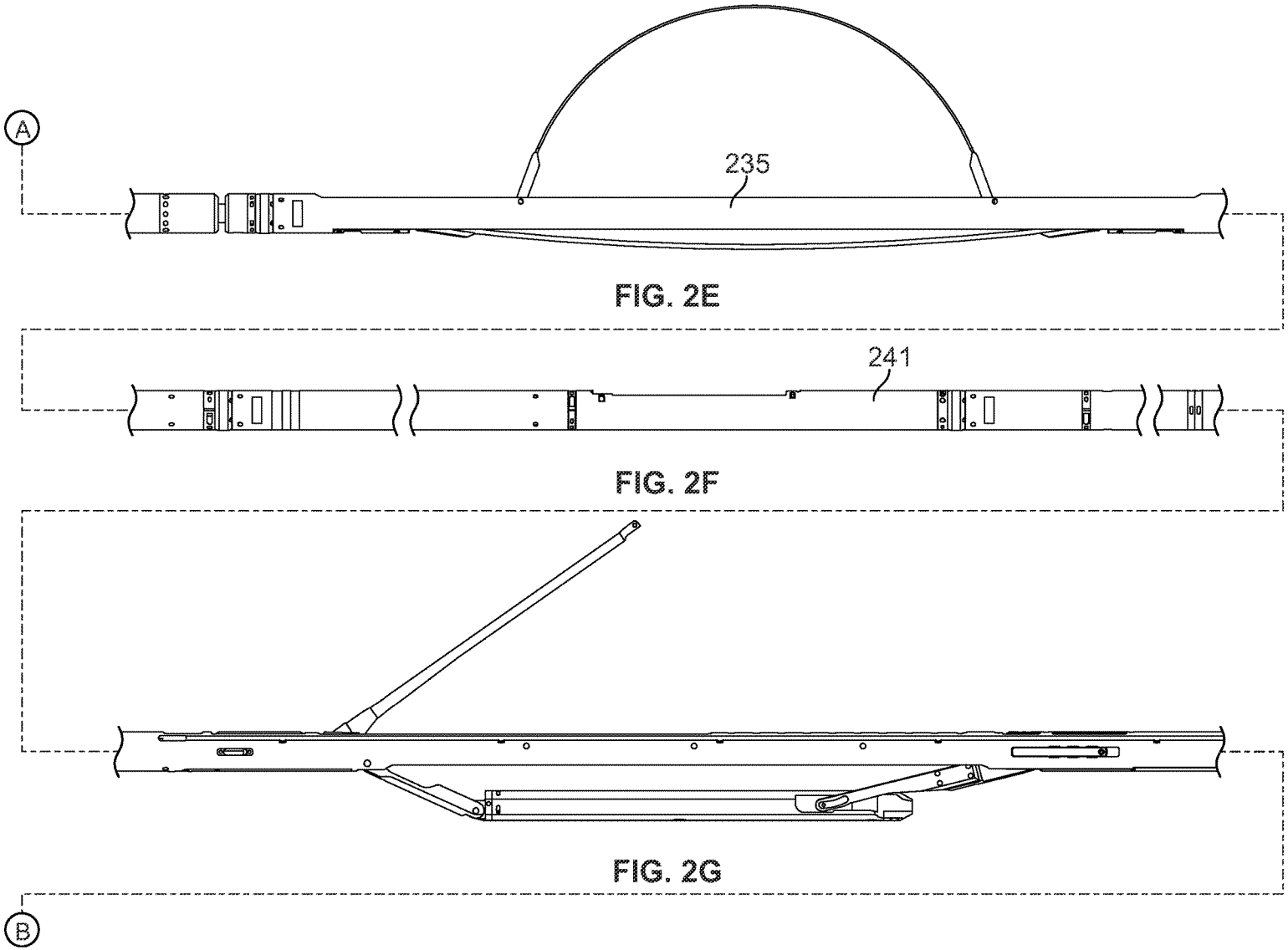

In FIGS. 2D and 2E, the logging assembly 220 further includes the telemetry gamma ray tool 231, a knuckle joint 233 and a decentralizer assembly 235. The telemetry gamma ray tool 231 can record naturally occurring gamma rays in the formations adjacent to the wellbore. This nuclear measurement can indicate the radioactive content of the formations. The knuckle joint 233 can allow angular deviation, although the knuckle joint 233 is placed as shown in FIG. 2D. It is possible that the knuckle joint 233 can be placed at a different location, or a number of more knuckle joints can be placed at other locations of the logging tool string 200. In some implementations, a swivel joint (not shown) may be included below the shock sub assembly 215 to allow rotational movement of the logging tool string. The decentralizer assembly 235 can enable the logging tool string 200 to be pressed against the wellbore 150.

In FIGS. 2F to 2I, the logging assembly 220 further includes the density neutron logging tool 241 and the borehole sonic array logging tool 243.

Figures 2H, 2I, 2J, 2K:
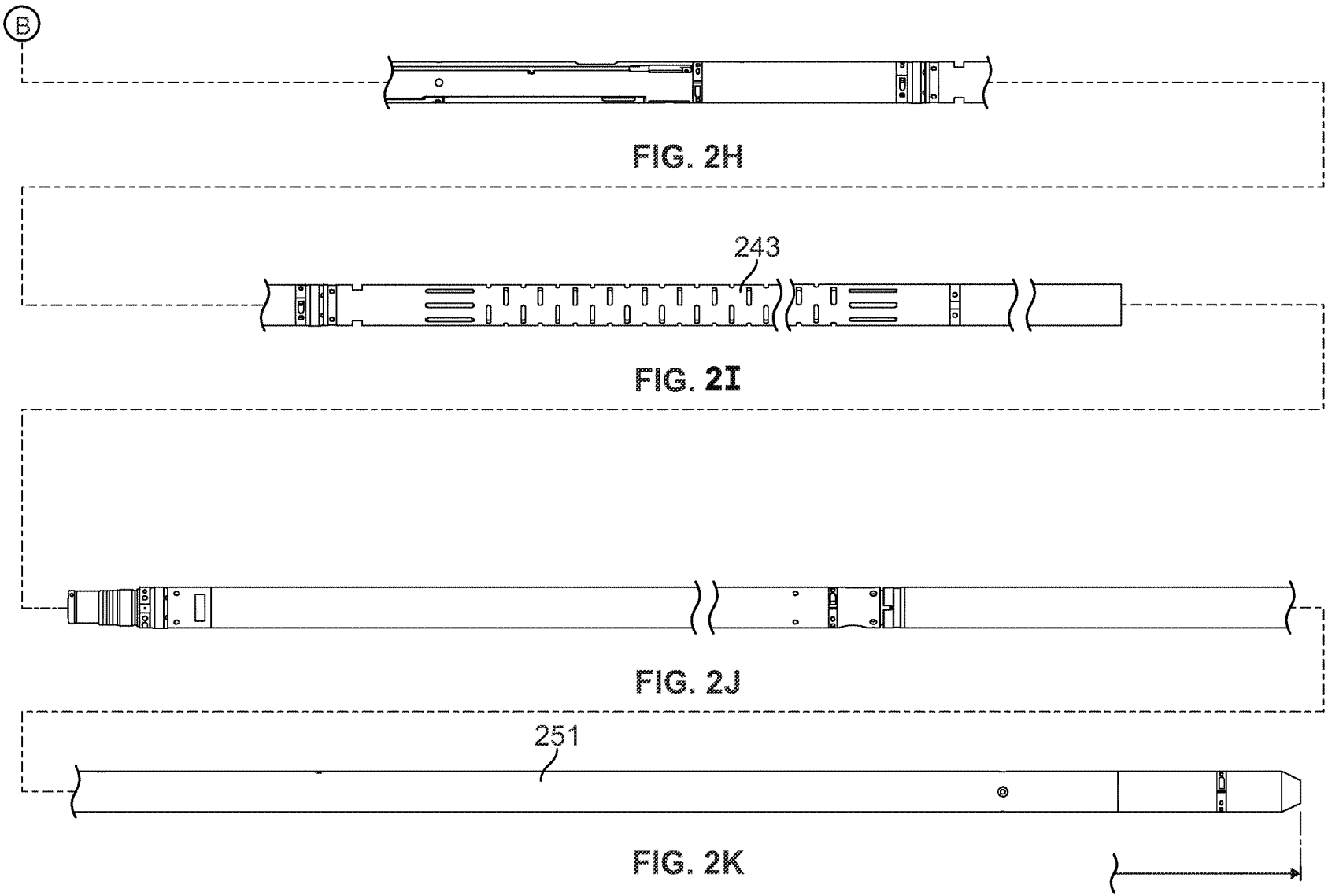

In FIGS. 2E and 2K, the logging assembly 220 further includes the compensated true resistivity tool array 251. In other possible configurations, the logging assembly 220 may include other data logging instruments besides those discussed in FIGS. 2A through 2K, or may include a subset of the presented instruments.

Figure 3B:
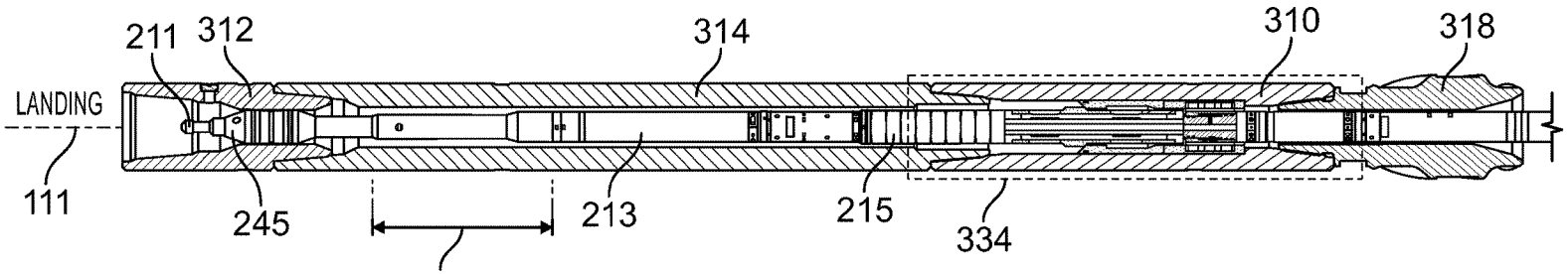
Figure 3C:
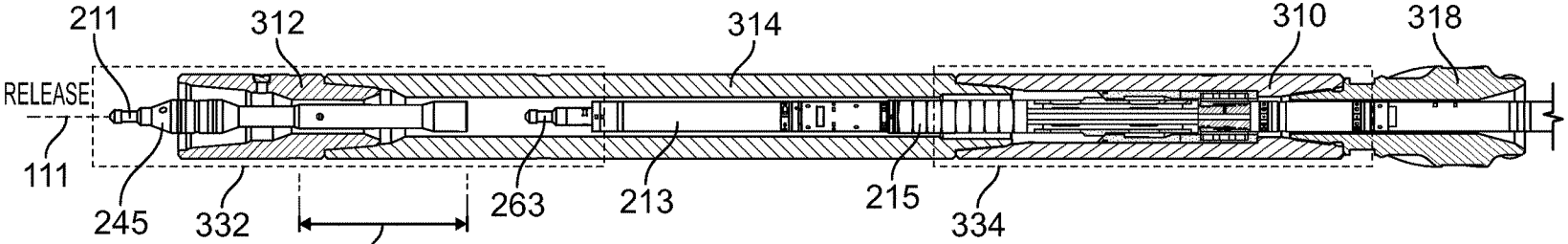

FIGS. 3A to 3C are cross-sectional side views of the logging tool string 200 inside the bottom hole assembly 300 during different operation phases. FIG. 3A shows the operation of the logging tool string 200 approaching the bottom hole assembly 300, which can correspond to the scenario shown in FIG. 1B. FIG. 3B shows the operation of the logging tool string 200 landing onto the bottom hole assembly 300, which can correspond to the scenario shown in FIG. 1C. FIG. 3C shows the operation of the logging tool string 200 releasing the running tool 202 after landing onto the bottom hole assembly 300, which can correspond to the scenario shown in FIG. 1D. FIG. 3C further illustrates two detail views: the detail view of the fluid flow portion 334 (FIG. 4) and the release operation detail view 332 (FIG. 5).

Referring to FIG. 3A, the logging tool string 200 is approaching the bottom hole assembly 300 for landing. The shock sub 215 includes a tool body 201 with a landing bumper 244 that has an outer diameter larger than the non-compressible outer diameter of the instruments in the logging assembly 220, so that the logging assembly 220 can go through the landing sub 310 without interfering with the bottom hole assembly 300. A landing bumper 244 outer diameter is larger than the inner diameter of the landing shoulder 344 so that the shock sub 215 can land the logging tool string onto the landing sub 310. For example, at landing the shock sub 215 can impact on the landing shoulder of the landing sub 310 and cease the motion of the logging tool string 200, as illustrated in FIG. 3B.

In FIG. 3C, after the logging tool string 200 is properly landed on the bottom hole assembly 300 and the switch (e.g., hall switch, reed switch etc.) is activated and the running tools 202 can be released from the rest of the logging tool string 200. The activation command requires that the switch remain closed for a pre-determined time period to eliminate false activations from magnetic anomalies found in the drill pipe. The release operation occurs at the motorized tool releasable subsection 213, where the spring release assembly 261 becomes disengaged from the fishing neck 263. The releasing operation can further be illustrated in FIG. 5, where the release operation detail view 332 is shown. Briefly referring to FIG. 5, the spring release assembly 261 is connected to the cable 111 through the crossover tool 211, the nozzle 245 and the extension rod 247. The nozzle 245 can seal with the nozzle sub 312 when the logging tool string 200 is landed to produce a distinct fluid pressure signature. The spring release assembly 261 may include a housing 256, a spring 258, and engaging dogs 249. At release in FIG. 3C, the running tool 202 is moved towards the surface 105 via reeling in the cable 111 at the logging truck 115.

FIG. 4 is a detail partial half cross-sectional view of the fluid flow portion 334 of the logging tool string and the bottom hole assembly illustrating fluid flow ports 242 and flow of fluid during landing of the logging tool string 200 in the bottom hole assembly 300. The drill fluid (F) flows down the drill pipe string through the spacer sub 314. The drill fluid (F) then enters the bypass ports 242 that are in the sidewall of the tool body 201. The bypass ports 242 are above the landing shoulders 344. The fluid (F) flows through the tool body 201 and exits at the ports 246 in the sidewall of the tool body 202 below the landing shoulder 344. The fluid (F) can then flow along the annular space between the logging tool string 200 and the bottom hole assembly 300 and eventually out of the terminal end of the bottom hole assembly 300.

During operation and referring to both FIG. 1C, FIG. 3B, and FIG. 4, the drill pipe string 114 is run into the wellbore 150 to a predetermined position. The drill pipe string 114 includes a longitudinal bore and the bottom hole assembly 300 that is connected to the lower end of the drill pipe string 114. The bottom hole assembly 300 includes the landing sub 310. The logging tool string 200 is inserted into the proximal upper end of the bore of the drill pipe string 114. The logging tool string 200 can include the landing assembly 210 and one or more logging tools (as shown in FIGS. 2A to 2K). In some implementations, the logging tool string 200 may be inserted into the drill pipe string 114 with tension support from a cable. the cable can be spooled out at the surface for lowering the logging tool string 200 down the longitudinal bore of the drill pipe string 114.

The fluid (F) is pumped into the upper proximal end of the drill pipe string 114 bore above the logging tool string 200 to assist movement of the logging tool sting 200 downwards with the fluid pressure applied onto the logging tool string 200. The fluid pressure is realized by the pressure differential between the fluid above the logging tool string 200 (e.g., greater pressure) and the fluid below the logging tool string 200 (e.g., lower pressure). As the logging tool string 200 lands, the fluid pressure below the logging tool string 200 can increase if the fluid flow is restricted due to the closing of fluid path. This can lower the net pressure that drives the logging tool string 200 downwards for landing. The implementation of fluid flow path of FIG. 4 can facilitate the fluid flow below the logging tool string 200 and therefore achieve a good driving pressure for landing the logging tool string 200.

Before the landing of the logging tool string 200, the fluid flow down the drill pipe string 114 and around the logging tool string 200. The fluid flows around the logging tool string 200 and out of the end of the bottom hole assembly 300. Fluid flow out the end or proximal to the end of the bottom hole assembly and up the annulus between the bottom hole assembly and the well bore wall assists in prevention of sticking the bottom hole assembly in the wellbore. The fluid (F) may be ultimately received at the surface and recirculated down the well bore. During landing, the landing assembly of the logging tool string 200 is landed in the landing sub 310. The landing assembly has a landing bumper 244 to engage the landing shoulder 344 of the landing sleeve 340 of the landing sub 310. At least a portion of the logging tool string 200 (e.g., the various logging tools of FIGS. 2A to 2K) is disposed below the distal end of the bottom hole assembly 310. After landing, the fluid (F) is diverted from the longitudinal bore of the drill pipe string 200 through at least one upper bypass port 242 in the landing assembly into at least one internal flow passage 249 in the landing assembly. The fluid flows through the internal passage 249 of the landing assembly and out of at least one lower bypass port 246 in the landing assembly. The fluid can then flow through an annular space 290 around the logging tool string 114 and out of the lower end of the bottom hole assembly 310. As noted above, fluid flow out the end or proximal to the end of the bottom hole assembly and up the annulus between the bottom hole assembly and the well bore wall assists in prevention of sticking the bottom hole assembly in the wellbore. The fluid (F) may be ultimately received at the surface and recirculated down the well bore. After the logging tool string 200 has landed, the logging tool string 200 can be pulled upward in the wellbore and record data obtained by one or more of the logging tools about the geologic formations penetrated by the wellbore.

Figure 6:
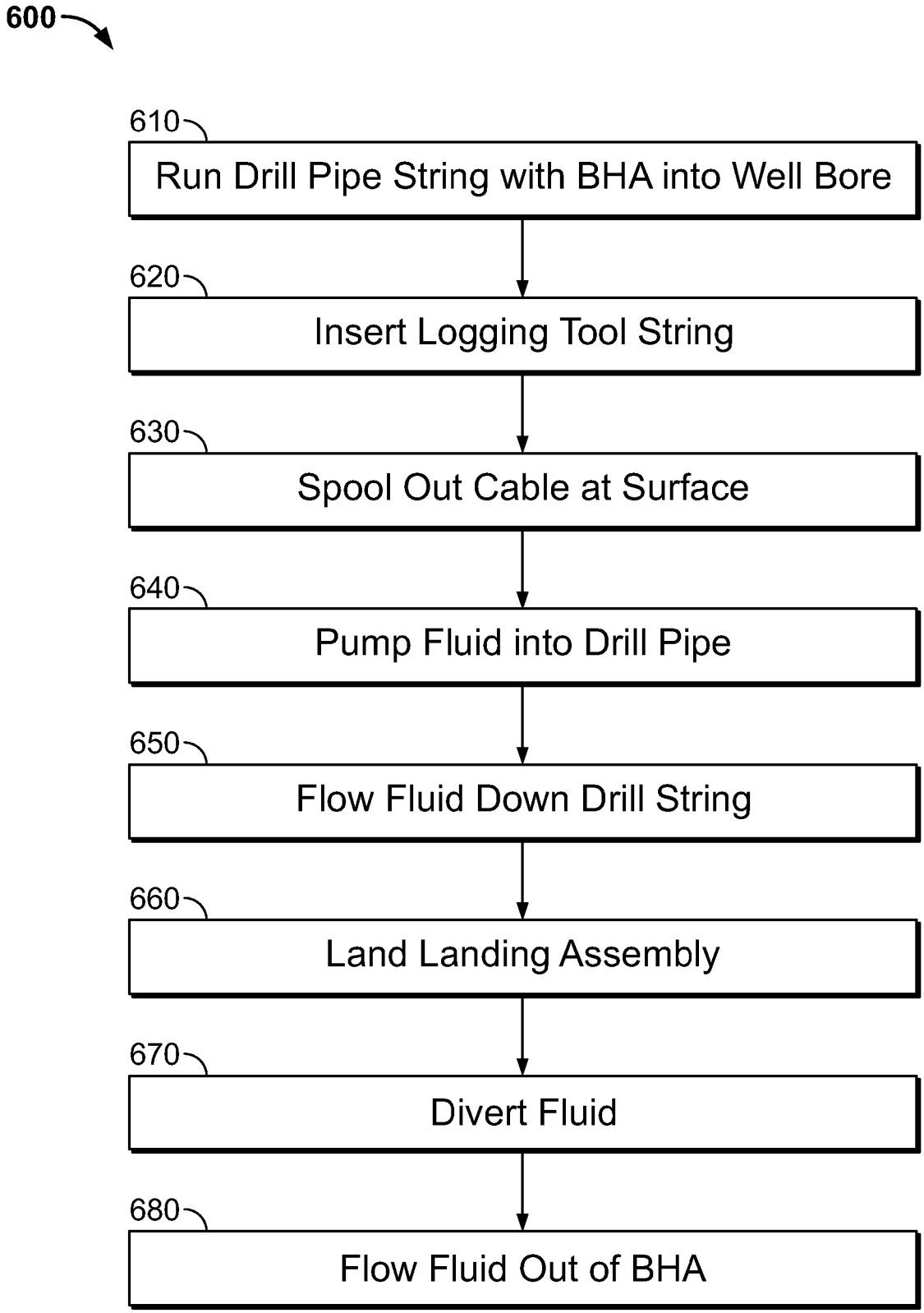
FIG. 6 is a flow chart illustrating the operations of landing the logging tool in the bottom hole assembly and fluid flow when the tool is landed.

FIG. 6 is a flow chart 600 illustrating the operations of landing the logging tool 200 in the bottom hole assembly 300. At 610, a drill pipe string is run into a wellbore to a predetermined position. The drill pipe has a longitudinal bore for conducting fluid, for example, drilling fluid, lubrication fluid, and others. The drill pipe string can include a landing sub with a longitudinal bore disposed proximal to the lower end of the drill pipe string. For example, the landing sub can be part of a bottom hole assembly installed at the lower end of the drill pipe string. In some implementations, the step 610 may be represented in FIG. 1A, where the wellbore 150 has a substantially deviated section and the drill pipe string 114 is run into the wellbore 150.

At 620, a logging tool string is inserted into the upper end of the bore of the drill pipe string. The logging tool string may have a battery powered memory logging device. The logging tool string can be attached to a cable via a crossover tool. The cable may be used to lower the logging tool string into the wellbore at a desired velocity. In some implementations, the step 620 may be represented in FIG. 1B, where the logging tool string 200 is inserted into the pipe string 114 at the upper end near the surface 105. The logging tool string 200 can have a running tool 202 (as in FIG. 2A) and can be attached to the cable 111 via the crossover tool 211.

At 630, the cable attached to the logging tool string is spooled out at the surface. The logging tool string is thereby lowered down the longitudinal bore of the drill pipe string. In some implementations, the step 630 may be represented in FIG. 1E, where the cable 111 is spooled out at the surface and the logging tool string 200 can be pumped downwards by fluid pressure.

At 640, a fluid is pumped into the upper proximal end of the drill pipe string bore above the logging tool string to assist movement of the logging tool string down the bore of the drill pipe string. The fluid pressure can be applied onto the logging tool string to propel the downward movement of the logging tool string.

At 650, the fluid flows down the drill pipe string while propelling the logging tool string downwards. The fluid flows around the logging tool string and out of the end of the bottom hole assembly. For example, the logging tool string has a diameter smaller than the bore diameter of the bottom hole assembly. The fluid flows in the gap between the outer surface of the logging tool string and the inner wall of the bottom hole assembly. The gap will eventually be closed as the logging tool string lands onto the bottom hole assembly. In some implementations, this may be represented in FIGS. 3A, 3B, and 4. In FIG. 3A, the fluid flows through the gap between the logging tool string 200 and the landing shoulder 344. The fluid can therefore generally flow around the logging tool string 200 and out of the end of the bottom hole assembly 300 (e.g., the deployment sub 318). In FIGS. 3B and 4, the landing bumper 244 will land onto the landing shoulder 344 and close the gap.

At 660, the logging tool string is landed in the landing sub of the drill pipe. At least a portion of the logging tool string that has logging tools (e.g., data logging instrument and equipment) is disposed below the bottom hole assembly located on the distal end of the drill pipe string. For example, in FIG. 4, the landing bumper 244 closes the gap between the outer surface of the logging tool string 200 and the bore of the landing sub 310 by landing onto the landing shoulder 344. The logging tools below the landing bumper 244 are inserted below the bottom hole assembly 300.

At 670, the fluid is diverted from the longitudinal bore of the drill pipe string through at least one upper bypass port in the landing assembly of the logging tool string into at least one internal flow passage in the landing assembly. The fluid flows through the internal passage way of the landing assembly and out at least one lower bypass port in the landing assembly. The fluid then flows through an annular space around the logging tool string. The annular space is created from the gap between the outer surface of the logging tool string and the bore wall of the bottom hole assembly. For example, in FIG. 4, the fluid (F) is diverted from the longitudinal bore of the drill pipe string 200 through at least one upper bypass port 242 in the landing assembly into at least one internal flow passage 249 in the landing assembly. The fluid flows through the internal passage 249 of the landing assembly and out of at least one lower bypass port 246 in the landing assembly.

At 680, the fluid flows out of the bottom hole assembly. As noted above, fluid flow out the end or proximal to the end of the bottom hole assembly and up the annulus between the bottom hole assembly and the well bore wall assists in prevention of sticking the bottom hole assembly in the wellbore. The fluid can circulate and maintain a pressure differential between the upper bypass port and the lower bypass port in the landing assembly.

A number of implementations have been described. Nevertheless, it will be understood that various modifications may be made. Further, the method 600 may include fewer steps than those illustrated or more steps than those illustrated. In addition, the illustrated steps of the method 600 may be performed in the respective orders illustrated or in different orders than that illustrated. As a specific example, the method 600 may be performed simultaneously (e.g., substantially or otherwise). Other variations in the order of steps are also possible. Accordingly, other implementations are within the scope of the following claims.

What is claimed is:

1. A method of fluid flow during landing of a well tool comprising:

running a drill pipe string into a wellbore, said drill pipe string including a bottom hole assembly with a landing sub, wherein the landing sub includes a landing sleeve having at least one magnet disposed therein;

lowering a logging tool string into the drill pipe string on a cable, said logging tool string comprising a landing assembly and one or more logging tools, and further wherein the logging tool includes a sensing device comprising a switch;

pumping a fluid through the drill pipe string and around the logging tool string to assist movement of the logging tool string down the bore of the drill pipe string;

landing the landing assembly of the logging tool string in the landing sub of the drill pipe string, with at least a portion of the logging tool string below a distal end of the bottom hole assembly, thereby bringing the sensing device proximate the at least one magnet in the landing sleeve to activate the switch;

diverting fluid from the drill pipe string through at least one upper bypass port in the landing assembly, through an internal passage way of the landing assembly, out at least one lower bypass port in the landing assembly, and through an annular space around the logging tool string; and flowing the fluid out of the bottom hole assembly after the landing assembly is landed in the landing sub of the drill pipe string.

2. The method of claim 1 wherein landing the landing assembly includes engaging a landing bumper of the logging tool string with a landing shoulder of the landing sub.

3. The method of claim 1 further comprising pulling the drill pipe string, with the logging tool string landed in the landing sub, upward in the wellbore and recording data obtained by the one or more logging tools about geologic formations penetrated by the wellbore as the logging tool string is pulled by the drill pipe string upward past the geologic formations.

4. The method of claim 1 further including:

flowing the fluid down the drill pipe string and around the logging tool string and out a lower end of the bottom hole assembly as the fluid is pumped down the drill string to assist movement of the logging tool string; and flowing the fluid discharged out of the lower end of the bottom hole assembly up an annulus between the bottom hole assembly and the wellbore.

5. The method of claim 4 further including;

flowing the fluid down the drill pipe string and around the logging tool string and out a the lower end of the bottom hole assembly after the landing of the logging tool string in the landing sub of the drill pipe string; and flowing the fluid discharged out of the lower end of the bottom hole assembly up the annulus between the bottom hole assembly and the wellbore.

6. An assembly for landing of a well tool in a wellbore, comprising:

a bottom hole assembly including a connector for attachment to a distal end of a drill pipe string, a landing sub having a bore there through, said landing sub including a landing sleeve disposed in the landing sub and at least one magnet disposed therein, and a landing shoulder in the landing sleeve; and a logging tool string including a landing assembly having at least one landing bumper engageable with the landing shoulder in the landing sleeve of the landing sub, said landing assembly including at least one upper bypass port from an outside of the landing assembly connected to at least one internal flow passage in the landing assembly, and at least one lower bypass port connecting the internal flow passage to the outside of the landing assembly, and at least one memory logging tool disposed below the landing assembly, and further wherein the logging tool includes a sensing device comprising a switch, the switch activatable when the sensing device in the logging tool string is brought proximate to the magnet in the landing sleeve.

7. The assembly of claim 6 wherein the at least one memory tool is operable to obtain data about at least one geologic formation penetrated by the wellbore.

8. A logging system for obtaining well log data from a wellbore comprising:

a drill pipe string disposed in a wellbore;

a bottom hole assembly coupled to the drill pipe string, the bottom hole assembly including a landing sub having a bore there through and at least one magnet disposed therein, said landing sub including a landing sleeve disposed in the landing sub and a landing shoulder disposed in the landing sleeve;

a logging tool string attached to a wireline deployable through the drill pipe string, a landing assembly having at least one landing bumper engageable with the landing shoulder in the landing sleeve of the landing sub, said landing assembly including at least one upper bypass port from an outside of the landing assembly connected to at least one internal flow passage in the landing assembly, and at least one lower bypass port connecting the internal flow passage to the outside of the landing assembly, and at least one memory logging tool disposed below the landing assembly, and further wherein the logging tool includes a sensing device comprising a switch, the switch activatable when the sensing device in the logging tool string is brought proximate to the magnet in the landing sleeve; and a surface pump system connected to the drill pipe string operable for pumping fluid down the drill pipe string before and after the landing assembly of the logging tool string has landed in the landing sub.

9. The system of claim 8 wherein the memory tool is operable to obtain data about at least one geologic formation penetrated by the wellbore.

10. The system of claim 9 wherein said fluid pumped down the drill pipe string flows out a lower end of the bottom hole assembly.

11. The system of claim 8 wherein said fluid pumped down the drill pipe string flows out a lower end of the bottom hole assembly.

* * * * *